US007322363B1

(12) United States Patent
Dillard

(10) Patent No.: US 7,322,363 B1
(45) Date of Patent: Jan. 29, 2008

(54) CONDITIONER DISPENSING HAIR BRUSH

(75) Inventor: Chico L. Dillard, 2816 Harmont Ave., Canton, OH (US) 44705

(73) Assignee: Chico L. Dillard, Canton, OH (US)

( * ) Notice: Subject to any disclaimer, the term of this patent is extended or adjusted under 35 U.S.C. 154(b) by 95 days.

(21) Appl. No.: 11/336,594

(22) Filed: Jan. 23, 2006

(51) Int. Cl.
*A45D 24/22* (2006.01)

(52) U.S. Cl. ..... 132/114; 132/112

(58) Field of Classification Search ..... 132/111–115, 132/901; 401/28, 101, 103, 183, 185; 601/96, 601/775, 160, 161
See application file for complete search history.

(56) References Cited

U.S. PATENT DOCUMENTS

| | | | | | |
|---|---|---|---|---|---|
| 1,501,089 | A | * | 7/1924 | Andrews | 401/28 |
| 1,637,249 | A | * | 7/1927 | Ames | 132/115 |
| 1,704,959 | A | * | 3/1929 | Ames | 132/115 |
| 2,110,323 | A | * | 3/1938 | Carns et al. | 132/115 |
| 2,645,231 | A | * | 7/1953 | Decker | 132/115 |
| 2,771,890 | A | * | 11/1956 | Jaberg | 132/115 |
| 4,277,193 | A | | 7/1981 | Knaus | |
| 4,605,026 | A | | 8/1986 | Nolin | |
| 5,054,504 | A | * | 10/1991 | Winrow | 132/114 |
| 5,339,839 | A | | 8/1994 | Forcelledo et al. | |
| D387,484 | S | | 12/1997 | Hong | |
| 6,065,891 | A | | 5/2000 | Rehman et al. | |
| 6,378,529 | B1 | | 4/2002 | Clemente Marco | |

* cited by examiner

*Primary Examiner*—Robyn Doan
(74) *Attorney, Agent, or Firm*—Ashkan Najafi, P.A.

(57) ABSTRACT

A hair brush includes a squeezable handle that has opposed ends provided with an opening. The handle has a chamber extending along a length thereof and a cap that is positional about the proximal end opening. A hygienic agent is housed within the chamber and is extractable through the distal end opening. A mechanism is included for contemporaneously dispensing the agent while the user combs their hair, wherein a brush head is conjoined to the distal handle end and is in communication with the chamber. The brush head includes a bore formed therein that is registered with the distal end opening and includes discharging fingers that are in communication with the bore. The fingers oscillate along a linear path as the user squeezes the handle. The fingers return to an equilibrium position when the agent is discharged therefrom and extend when a new quantity of the agent enters same.

12 Claims, 7 Drawing Sheets

CONDITIONER DISPENSING HAIR BRUSH

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to dispensing brushes and, more particularly, to a conditioner dispensing brush for contemporaneously dispensing a hygienic agent while a user combs their hair.

2. Prior Art

The use of aerosols for imparting treating agents or grooming aids to the hair is quite expensive. Both aerosols and manual sprays are rather messy because overspray frequently results in deposits of treating agent on a person's face or clothing. Spray applications of liquid treating agent to the hair also tends to wet only the surface of the hair and it is difficult to obtain uniform wetting of the entire hair mass. Applying liquid treating agent to the hands and then transferring the agent from the hands to the hair is very messy and still difficult to achieve uniform wetting because much of the agent clings to the first mass of hair touched by the hands.

Prior devices for wetting the hair with a liquid treating agent without the use of sprays and without wetting the hands include brush and comb, or the comb and fibrous material, which are mounted on a common head at spaced locations. This makes the head very bulky. Liquid treating agent is supplied to the brush or fibrous material which is exposed at all times, even when the comb alone is being used. The wet brush or fibrous material is always exposed and this makes it inconvenient to carry the device in a handbag or the like. In addition, liquid treating agent can leak from the brush or fibrous material while the comb alone is being used, and the treating agent may fall upon a person's clothes or otherwise be a nuisance.

Other grooming devices are disclosed for imparting a liquid treating agent to a comb or applicator tool. In these devices, an applicator tool or comb is inserted into a pocket or reservoir for being wetted with a liquid treating agent. The comb is then removed from the pocket or reservoir to transfer the agent to the hair. This method has the same disadvantage as when applying the liquid agents by hand, wherein a majority of the treating agent is deposited onto the first mass of hair that is contacted by the comb or tool. This results in an uneven application that is not desirable when applying agents, such as hair conditioners and hair coloring agents.

Accordingly, a need remains for a conditioner dispensing brush in order to overcome the above-noted shortcomings. The present invention satisfies such a need by providing a dispensing brush that is easy and convenient to use, is versatile in its uses, light weight and durable in design, and results in an even and neat application of the desired hair agent. Such a dispensing brush serves as a viable alternative to traditional methods of applying conditioners, moisturizers etc. onto one's hair and scalp. The apparatus thus helps a person to properly nourish and cleanse their hair and scalp, and keep it healthy for longer periods of time. Such a dispensing brush also provides the user with a convenient spill-free method of application and with greater control of the amount of agent that is applied. The apparatus is appreciable by any person who wishes to simplify his/her hairstyling routine, as well as by professional hairstylists and salon owners.

BRIEF SUMMARY OF THE INVENTION

In view of the foregoing background, it is therefore an object of the present invention to provide a conditioner dispensing hair brush. These and other objects, features, and advantages of the invention are provided by a hair brush for contemporaneously dispensing a hygienic agent while a user combs their hair.

The hair brush includes a squeezable handle that is suitably sized and shaped for fitting within a hand of the user. Such a handle has a deformably resilient outer surface. The handle has a centrally oriented longitudinal axis and axially opposed proximal and distal ends provided with an opening respectively. Such a handle further has a hollow interior defining a unitary and continuous chamber extending along an entire longitudinal length of the handle. The handle also includes a cap that is removably positional directly about the proximal end opening for advantageously and effectively prohibiting undesirable foreign objects from entering the chamber during operating conditions.

A predetermined quantity of a hygienic agent that has a fluid viscosity is housed within the chamber. Such a hygienic agent is extractable through the distal end opening when the user squeezes the handle and applies an exterior force tangentially against the chamber.

A mechanism is included for contemporaneously dispensing the hygienic agent while flhe user combs their hair. Such a contemporaneously dispensing mechanism includes a brush head that is directly and removably conjoined to the distal end of the handle and is in fluid communication with the chamber such that the hygienic agent is effectively caused to linearly displace through the handle and exit upwardly away therefrom. Brush head further includes a bore formed therein that is axially aligned with the axis of the handle and registered with the distal end opening for conveniently and effectively receiving the hygienic agent therethrough. Such a bore may have an interior wall that equidistantly extends along an interior surface of the first and second arcuate faces. The interior wall of the bore converges upwardly towards the apex wherein the fingers conveniently and effectively receive the hygienic agent therefrom.

The brush head includes a plurality of discharging fingers that have coextensive linear shapes in fluid communication with the bore. Such fingers are formed from non-corrosive material. The discharging fingers selectively oscillate along a linear path defined orthogonal to the axis as the user squeezes the handle such that the hygienic agent is effectively caused to discharge out from the fingers in a uniform rate. Such fingers return to an equilibrium position when the hygienic agent is discharged outwardly therefrom until a new quantity of the hygienic agent enters the fingers to thereby cause the fingers to bias outwardly to an extended position. Each of the fingers may be provided with a linear slot that extends along an entire longitudinal length thereof respectively. Such slots are centrally formed within the fingers and extend upwardly along the longitudinal length thereof for effectively directing the hygienic agent out from the brush head. The linear slots are in fluid and continuous communication with the bore.

The brush head preferably includes first and second arcuate faces that are equidistantly offset from the axis and flange outwardly away therefrom. Such first and second arcuate faces have a monolithically formed apex situated at a base of the fingers wherein the fingers rise and fall between the extended and equilibrium positions directly through the apex. The apex extends along an entire longitudinal length of the brush head and compresses the hygienic agent upwardly towards the fingers such that the hygienic agent can conveniently and advantageously be effectively extracted from the fingers without clogging the bore.

In an alternate embodiment, the brush head preferably includes a planar top face that extends orthogonal to the axis and has a width greater than a diameter of the handle. The fingers effectively and advantageously cover an entire surface area of the top face.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figures 1, 8:
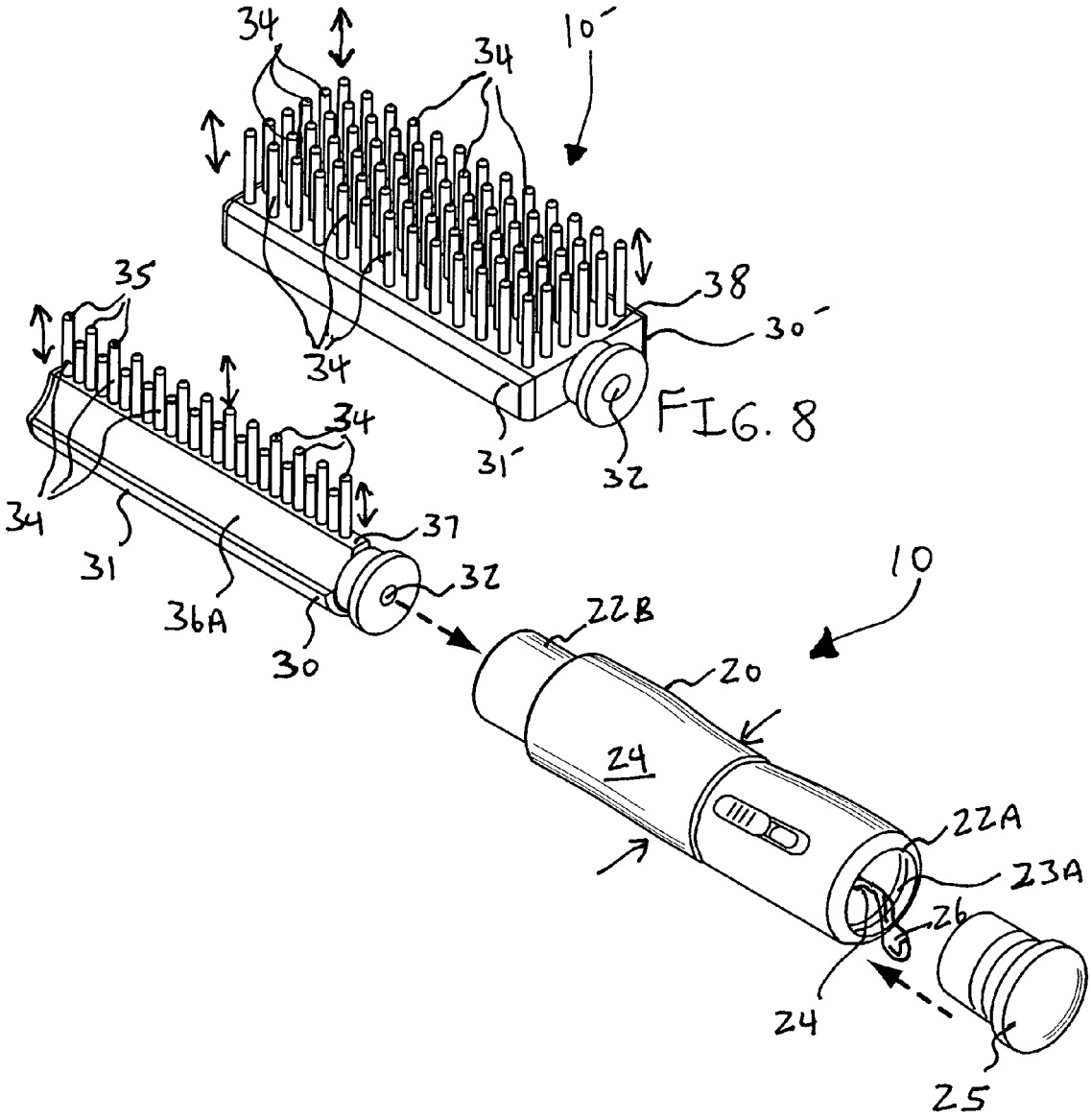
FIG. 1 is an exploded rear perspective view showing a conditioner dispensing hair brush, in accordance with the present invention.
FIG. 8 is a perspective view showing an alternate embodiment of the brush head shown in FIGS. 1 through 7.
Figure 2:
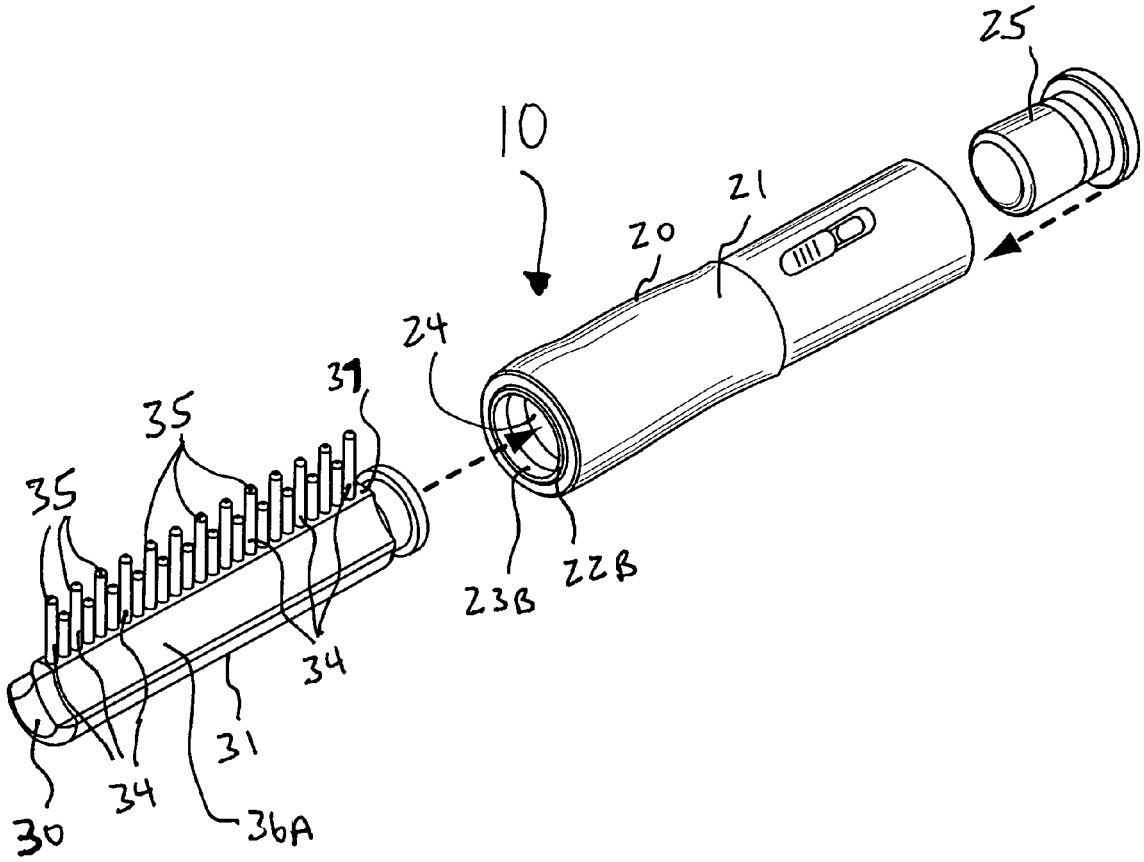
FIG. 2 is an exploded front perspective view of the apparatus shown in FIG. 1.
Figure 3:
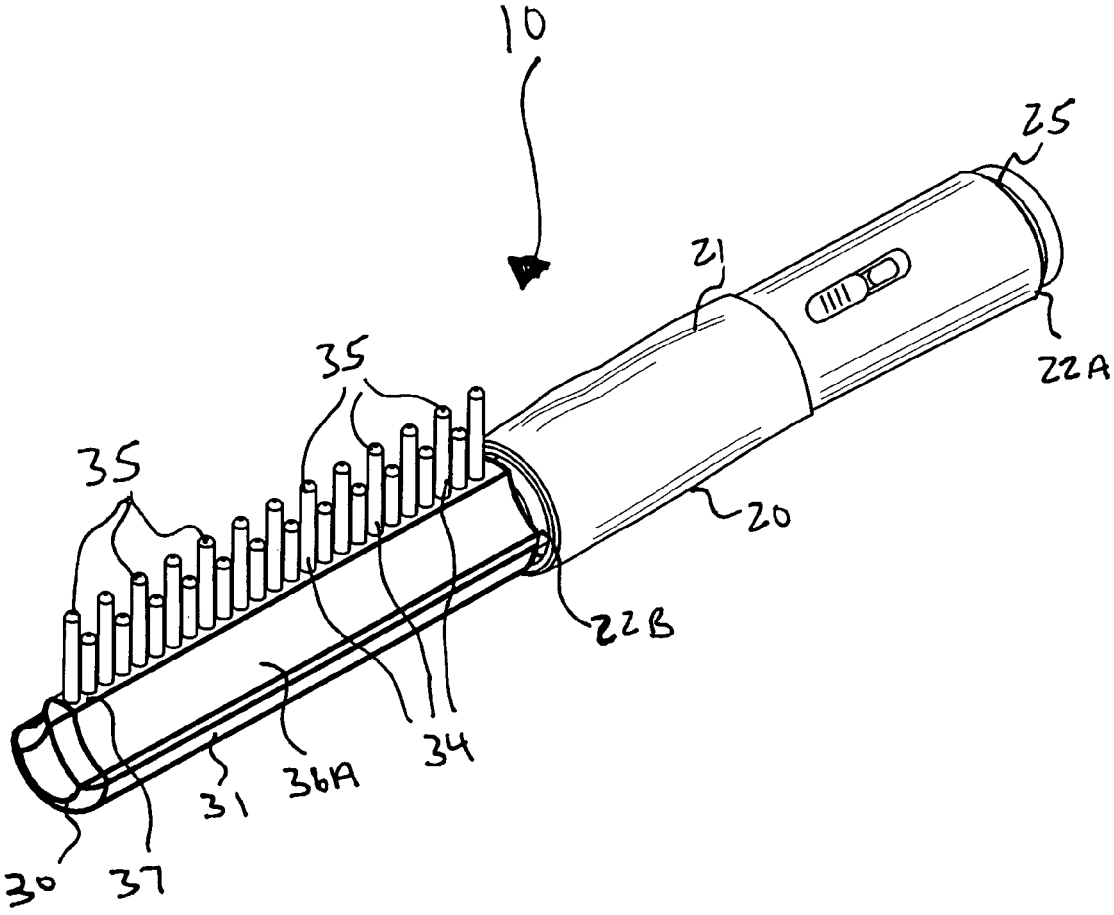
FIG. 3 is a perspective view of the apparatus shown in FIG. 2.
Figure 4:
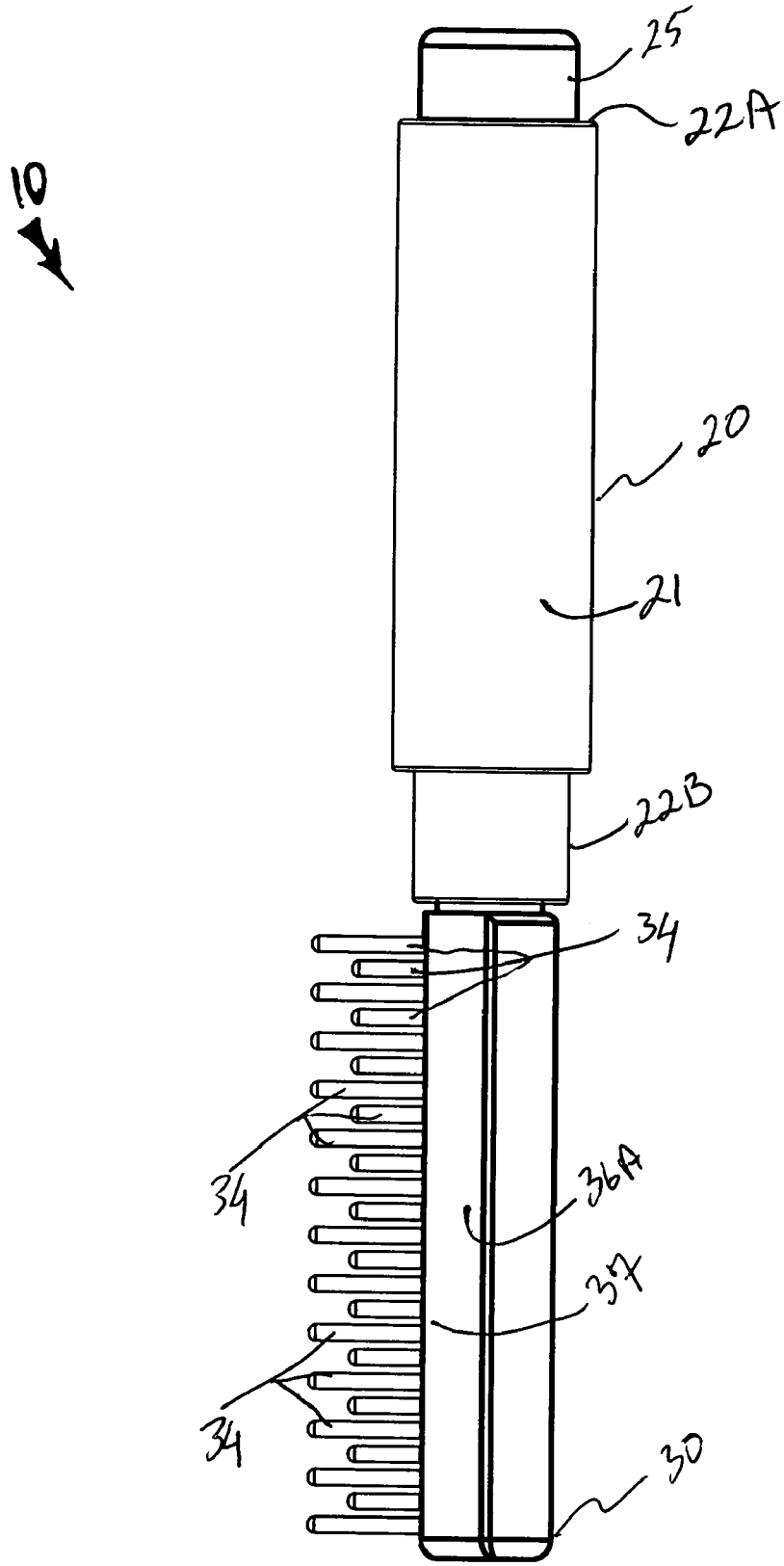
FIG. 4 is a side-elevational view of the apparatus shown in FIG. 3.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to an alternate embodiment of such elements.

The apparatus of this invention is referred to generally in FIGS. 1-9 by the reference numeral 10 and is intended to provide a conditioner dispensing hair brush. It should be understood that the apparatus 10 may be used to dispense many different types of hygienic agents and should not be limited in use to only dispensing hair conditioners/moisturizers therefrom.

Referring initially to FIGS. 1 through 7, the apparatus 10 includes a squeezable handle 20 that is suitably sized and shaped for fitting within a hand of the user. Such a handle 20 has a deformably resilient outer surface 21. The handle 20 has a centrally oriented longitudinal axis and axially opposed proximal 22A and distal 22B ends provided with an opening 23A, 23B respectively. Such a handle 20 further has a hollow interior defining a unitary and continuous chamber 24 extending along an entire longitudinal length of the handle 20. Of course, the handle 20 and the chamber 24 may be produced in a variety of alternate shapes and sizes, as is obvious to a person of ordinary skill in the art. The handle 20 also includes a cap 25 that is removably positional directly, without the use of intervening elements, about the proximal end opening 23A, which is essential and advantageous for effectively prohibiting undesirable foreign objects from entering the chamber 24 during operating conditions.

Referring to FIG. 1, a predetermined quantity of a hygienic agent 26 that has a fluid viscosity is housed within the chamber 24. Such a hygienic agent 26 is extractable through the distal end opening 23B when the user squeezes the handle 20 and applies an exterior force tangentially against the chamber 24. This feature advantageously eliminates the need for a user to manually handle the hygienic agent 26, which can be messy, while also allowing a person to regulate the amount of hygienic agent 26 that is being dispensed onto their hair.

Referring to FIGS. 1 through 7, a mechanism 30 is included for contemporaneously dispensing the hygienic agent 26 while the user combs their hair. Such a contemporaneously dispensing mechanism 30 includes a brush head 31 that is directly and removably conjoined, without the use of intervening elements, to the distal end 22B of the handle 20 and is in fluid communication with the chamber 24, which is crucial such that the hygienic agent 26 is effectively caused to linearly displace through the handle 20 and exit upwardly away therefrom.

The brush head 31 further includes a bore 32 formed therein that is axially aligned with the axis of the handle 20 and registered with the distal end opening 23B for conveniently and effectively receiving the hygienic agent 26 therethrough. Such a bore 32 has an interior wall 33 that equidistantly extends along an interior surface of the first 36A and second 36B arcuate faces (described herein below). The interior wall 33 of the bore 32 converges upwardly towards the apex 37 (described herein below) wherein the fingers 34 (described herein below) conveniently and effectively receive the hygienic agent 26 therefrom.

Again referring to FIGS. 1 through 7, the brush head 31 includes a plurality of discharging fingers 34 that have coextensive linear shapes in fluid communication with the bore 32. Of course, the brush head 31 may be produced to have various amounts of fingers 34 and to have fingers 34 of various lengths, depending on the user's needs and hair type, as is obvious to a person of ordinary skill in the art. Such fingers 34 are formed from non-corrosive material, which is important and advantageous for allowing various hygienic agents 26 to be displaced through the fingers 34 without causing damage thereto.

The discharging fingers 34 selectively oscillate along a linear path defined orthogonal to the axis as the user squeezes the handle 20, which is vital and advantageous such that the hygienic agent 26 is effectively caused to discharge out from the fingers 34 in a uniform rate. Such fingers 34 return to an equilibrium position when the hygienic agent 26 is discharged outwardly therefrom until a new quantity of the hygienic agent 26 enters the fingers 34 to thereby cause the fingers 34 to bias outwardly to an extended position. Each of the fingers 34 is provided with a linear slot 35 that extends along an entire longitudinal length thereof respectively. Such slots 35 are centrally formed within the fingers 34 and extend upwardly along the longitudinal length thereof for effectively directing the hygienic agent 26 out from the brush head 31. The linear slots 35 are in fluid and continuous communication with the bore 32.

Still referring to FIGS. 1 through 7, the brush head 31 includes first 36A and second 36B arcuate faces that are equidistantly offset from the axis and flange outwardly away therefrom. Such first 36A and second 36B arcuate faces have a monolithically formed apex 37 situated at a base of the fingers 34 wherein the fingers 34 rise and fall between the extended and equilibrium positions directly through the apex 37. The apex 37 extends along an entire longitudinal length of the brush head 31 and compresses the hygienic agent 26 upwardly towards the fingers 34, which is crucial such that the hygienic agent 26 can conveniently and advantageously be effectively extracted from the fingers 34 without clogging the bore 32.

Figures 5, 9:
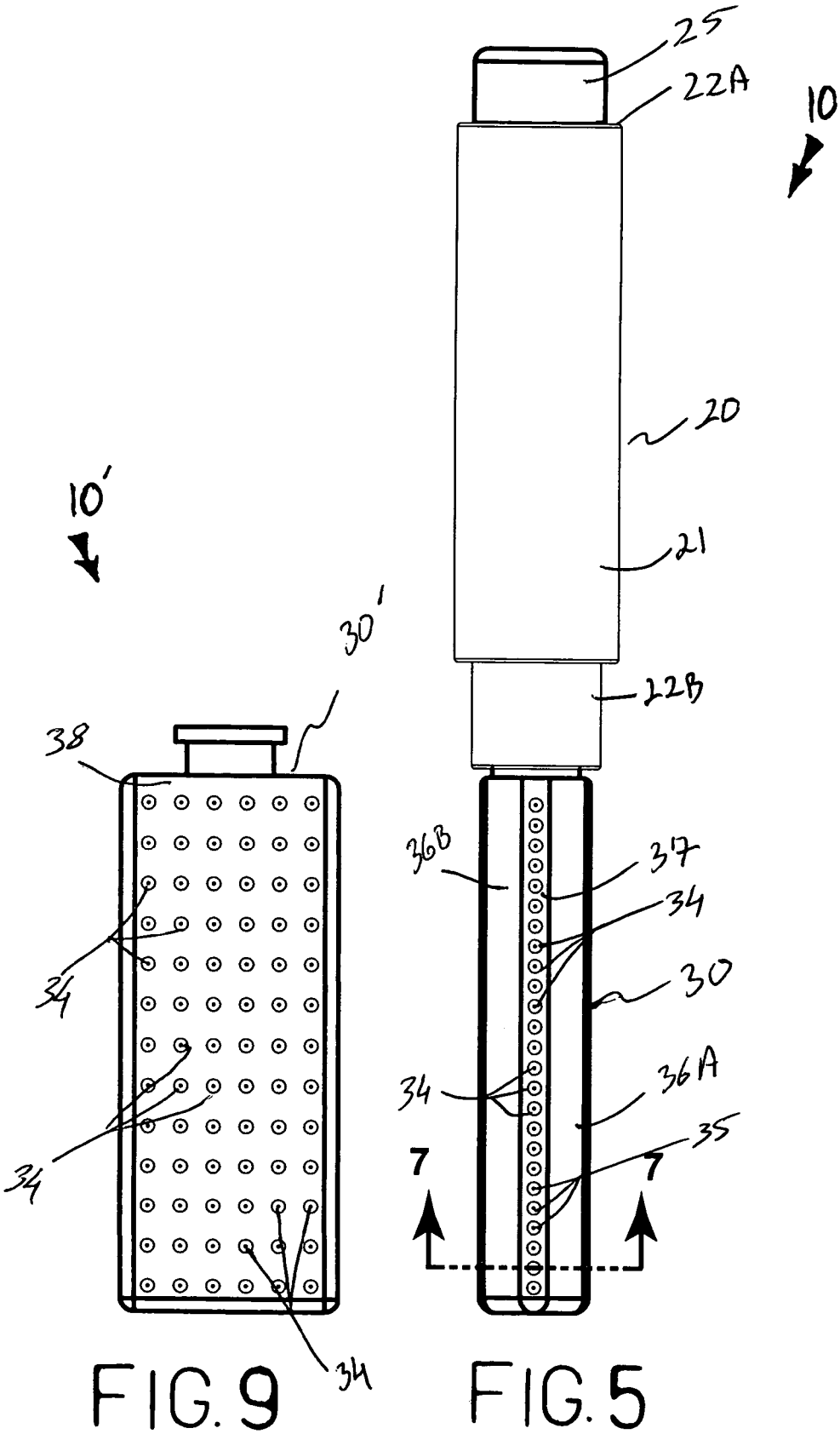
FIG. 5 is a top plan view of the apparatus shown in FIG. 4.
FIG. 9 is a top plan view of the brush head shown in FIG. 8.
Figure 6:
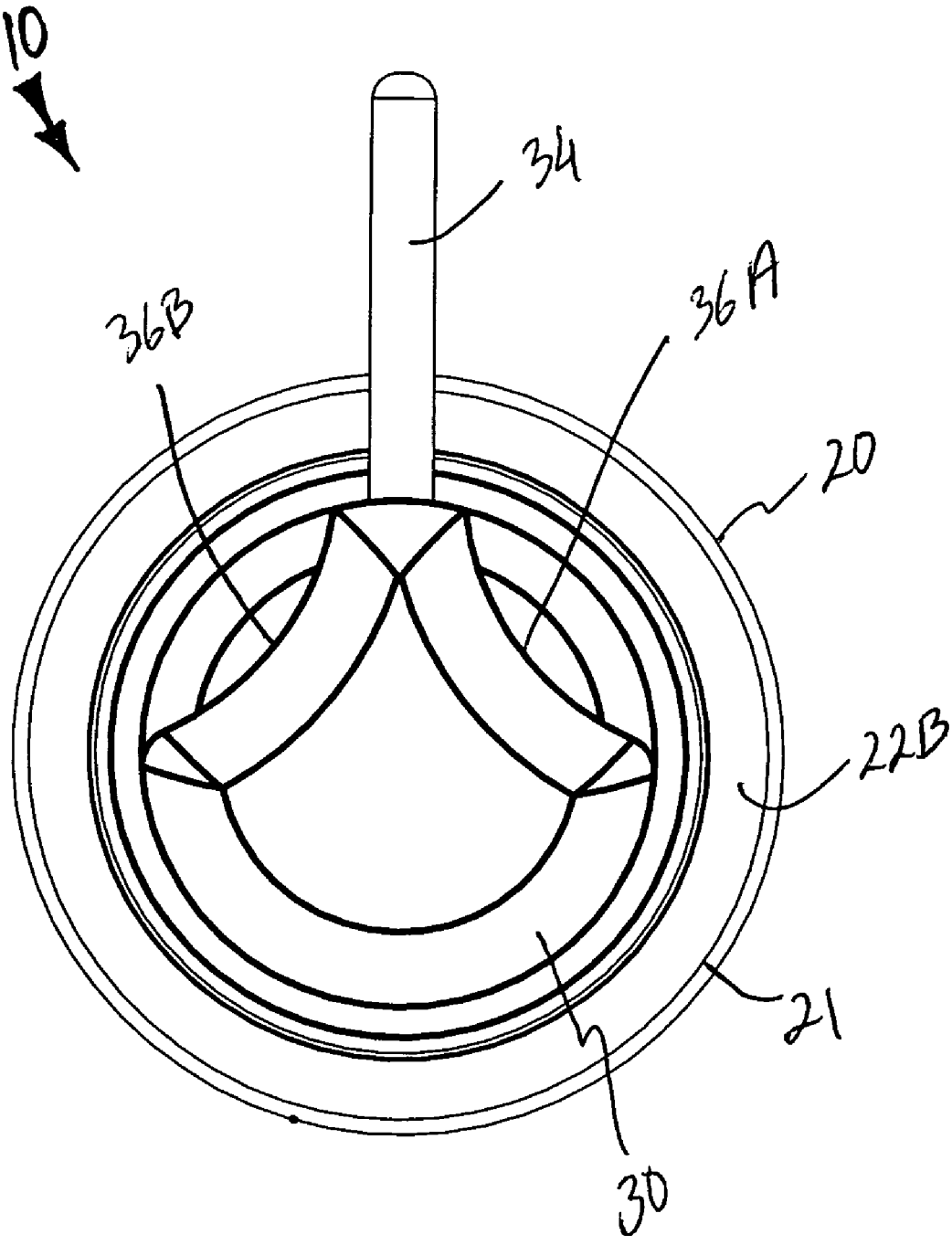
FIG. 6 is a front elevational view of the apparatus shown in FIG. 5.
Figure 7:
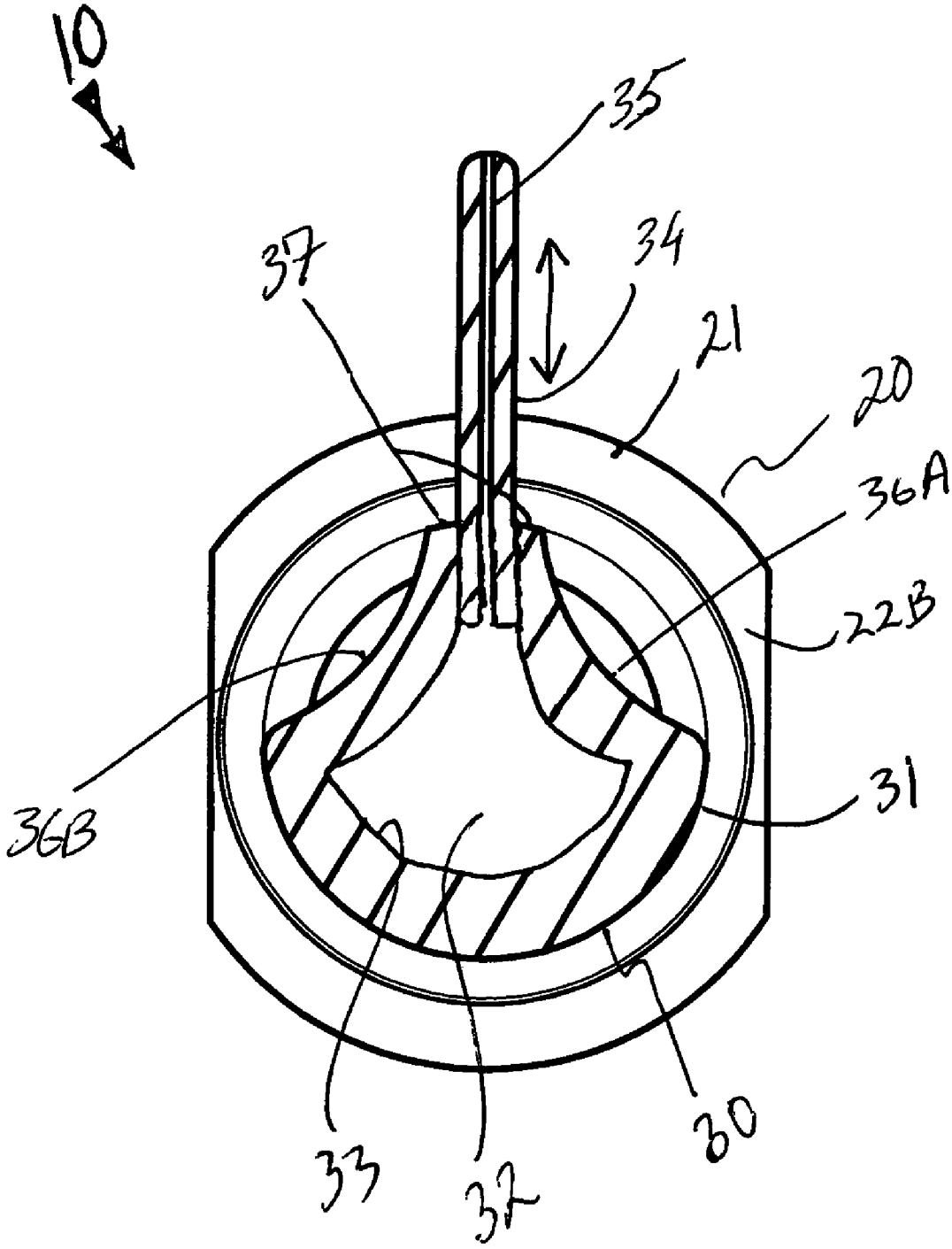
FIG. 7 is a cross-sectional view of the apparatus shown in FIG. 5, taken along line 7-7 and showing the bore formed in the brush head.

Referring to FIGS. 8 and 9, in an alternate embodiment 10', the contemporaneously dispensing mechanism 30' includes a brush head 31' that has a planar top face 38 that extends orthogonal to the axis and has a width greater than a diameter of the handle 20. The fingers 34 effectively and advantageously cover an entire surface area of the top face 38. Such a brush head 31' advantageously allows a user to more quickly apply a quantity of hygienic agent 26 and may also be more suitable for use by persons with thick or curly hair.

In use, the individual simply fills the hollow chamber 24 with any desired hygienic agent 26, such as conditioners, relaxing agents, shampoos, coloring agents etc. The cap 25 is then attached to the proximal end 22A for advantageously and effectively maintaining the hygienic agent 26 within the chamber 24. A person can then continue to evenly brush or comb their hair while periodically squeezing the handle 20 for conveniently and effectively excreting a desired amount of hygienic agent 26. The apparatus 10 thus provides the user with a neat and timesaving method of cleaning and nourishing their hair and scalp.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hair brush for contemporaneously dispensing a hygienic agent while a user combs their hair, said hair brush comprising:

a squeezable handle suitably sized and shaped for fitting within a hand of the user, said handle having a centrally oriented longitudinal axis and axially opposed proximal and distal ends provided with an opening respectively, said handle further having a hollow interior defining a unitary and continuous chamber extending along an entire longitudinal length of said handle, said handle including a cap removably positional directly about said proximal end opening for prohibiting undesirable foreign objects from entering said chamber during operating conditions;

a predetermined quantity of a hygienic agent having a fluid viscosity and housed within said chamber, said hygienic agent being extractable through said distal end opening when the user squeezes said handle and applies an exterior force tangentially against said chamber; and means for contemporaneously dispensing said hygienic agent while the user combs their hair, said contemporaneously dispensing means including a brush head directly and removably conjoined to said distal end of said handle and in fluid communication with said chamber such that said hygienic agent is caused to linearly displace through said handle and exit upwardly away therefrom, said contemporaneously dispensing means further including a bore formed therein and axially aligned with the axis of said handle and registered with said distal end opening for receiving said hygienic agent therethrough;

wherein said brush head includes a plurality of discharging fingers having coextensive linear shapes in fluid communication with said bore;

wherein said brush head comprises first and second arcuate faces equidistantly offset from the axis and flanging outwardly away therefrom, said first and second arcuate faces having a monolithically formed apex situated at a base of said fingers wherein said fingers rise and fall between said extended and equilibrium positions directly through said apex, said apex extending along an entire longitudinal length of said brush head and compressing said hygienic agent upwardly towards said fingers such that said hygienic agent can be effectively extracted from said fingers without clogging said bore.

2. The apparatus of claim 1, wherein said bore has an interior wall equidistantly extending along an interior surface of said first and second arcuate faces, said interior wall of said bore converging upwardly towards said apex wherein said fingers receive said hygienic agent therefrom.

3. The apparatus of claim 1, wherein each said fingers is provided with a linear slot extending along an entire longitudinal length thereof respectively, said slots being centrally formed within said fingers and extending upwardly along the longitudinal length thereof for directing said hygienic agent out from said brush head, said linear slots being in fluid and continuous communication with said bore.

4. The apparatus of claim 1, wherein said brush head comprises:

a planar top face extending orthogonal to said axis and having a width greater than a diameter of said handle, said fingers covering an entire surface area of said top face.

5. A hair brush for contemporaneously dispensing a hygienic agent while a user combs their hair, said hair brush comprising:

a squeezable handle suitably sized and shaped for fitting within a hand of the user, wherein said handle has a deformably resilient outer surface, said handle having a centrally oriented longitudinal axis and axially opposed proximal and distal ends provided with an opening respectively, said handle further having a hollow interior defining a unitary and continuous chamber extending along an entire longitudinal length of said handle, said handle including a cap removably positional directly about said proximal end opening for prohibiting undesirable foreign objects from entering said chamber during operating conditions;

a predetermined quantity of a hygienic agent having a fluid viscosity and housed within said chamber, said hygienic agent being extractable through said distal end opening when the user squeezes said handle and applies an exterior force tangentially against said chamber; and means for contemporaneously dispensing said hygienic agent while the user combs their hair, said contemporaneously dispensing means including a brush head directly and removably conjoined to said distal end of said handle and in fluid communication with said chamber such that said hygienic agent is caused to linearly displace through said handle and exit upwardly away therefrom, said contemporaneously dispensing means further including a bore formed therein and axially aligned with the axis of said handle and registered with said distal end opening for receiving said hygienic agent therethrough;

wherein said brush head includes a plurality of discharging fingers having coextensive linear shapes in fluid communication with said bore;

wherein said brush head comprises first and second arcuate faces equidistantly offset from the axis and flanging outwardly away therefrom, said first and second arcuate faces having a monolithically formed apex situated at a base of said fingers wherein said fingers rise and fall between said extended and equilibrium positions directly through said apex, said apex extending along an entire longitudinal length of said brush head and compressing said hygienic agent upwardly towards said fingers such that said hygienic agent can be effectively extracted from said fingers without clogging said bore.

6. The apparatus of claim 5, wherein said bore has an interior wall equidistantly extending along an interior surface of said first and second arcuate faces, said interior wall of said bore converging upwardly towards said apex wherein said fingers receive said hygienic agent therefrom.

7. The apparatus of claim 5, wherein each said fingers is provided with a linear slot extending along an entire longitudinal length thereof respectively, said slots being centrally formed within said fingers and extending upwardly along the longitudinal length thereof for directing said hygienic agent out from said brush head, said linear slots being in fluid and continuous communication with said bore.

8. The apparatus of claim 5, wherein said brush head comprises:

a planar top face extending orthogonal to said axis and having a width greater than a diameter of said handle, said fingers covering an entire surface area of said top face.

9. A hair brush for contemporaneously dispensing a hygienic agent while a user combs their hair, said hair brush comprising:

a squeezable handle suitably sized and shaped for fitting within a hand of the user, wherein said handle has a deformably resilient outer surface, said handle having a centrally oriented longitudinal axis and axially opposed proximal and distal ends provided with an opening respectively, said handle further having a hollow interior defining a unitary and continuous chamber extending along an entire longitudinal length of said handle, said handle including a cap removably positional directly about said proximal end opening for prohibiting undesirable foreign objects from entering said chamber during operating conditions;

a predetermined quantity of a hygienic agent having a fluid viscosity and housed within said chamber, said hygienic agent being extractable through said distal end opening when the user squeezes said handle and applies an exterior force tangentially against said chamber; and means for contemporaneously dispensing said hygienic agent while the user combs their hair, said contemporaneously dispensing means including a brush head directly and removably conjoined to said distal end of said handle and in fluid communication with said chamber such that said hygienic agent is caused to linearly displace through said handle and exit upwardly away therefrom, said contemporaneously dispensing means further including a bore formed therein and axially aligned with the axis of said handle and registered with said distal end opening for receiving said hygienic agent therethrough;

wherein said brush head includes a plurality of discharging fingers having coextensive linear shapes in fluid communication with said bore, wherein said fingers are formed from non-corrosive material;

wherein said brush head comprises first and second arcuate faces equidistantly offset from the axis and flanging outwardly away therefrom, said first and second arcuate faces having a monolithically formed apex situated at a base of said fingers wherein said fingers rise and fall between said extended and equilibrium positions directly through said apex, said apex extending along an entire longitudinal length of said brush head and compressing said hygienic agent upwardly towards said fingers such that said hygienic agent can be effectively extracted from said fingers without clogging said bore.

10. The apparatus of claim 9, wherein said bore has an interior wall equidistantly extending along an interior surface of said first and second arcuate faces, said interior wall of said bore converging upwardly towards said apex wherein said fingers receive said hygienic agent therefrom.

11. The apparatus of claim 9, wherein each said fingers is provided with a linear slot extending along an entire longitudinal length thereof respectively, said slots being centrally formed within said fingers and extending upwardly along the longitudinal length thereof for directing said hygienic agent out from said brush head, said linear slots being in fluid and continuous communication with said bore.

12. The apparatus of claim 9, wherein said brush head comprises:

a planar top face extending orthogonal to said axis and having a width greater than a diameter of said handle, said fingers covering an entire surface area of said top face.

* * * * *